United States Patent [19]

Wiygul, Jr.

[11] Patent Number: 4,974,526

[45] Date of Patent: Dec. 4, 1990

[54] PORTABLE SELF-STORING FOLDING TABLE

[76] Inventor: Frank H. Wiygul, Jr., 150 Howell Cir., #318, Greenville, S.C. 29615

[21] Appl. No.: 289,775

[22] Filed: Dec. 27, 1988

[51] Int. Cl.[5] ..... A47B 3/06

[52] U.S. Cl. ..... 108/159; 108/157; 312/140.2

[58] Field of Search ..... 108/159, 153, 157, 111, 108/112; 312/140.2

[56] References Cited

U.S. PATENT DOCUMENTS

| | | | |
|---|---|---|---|
| 1,963,594 | 6/1934 | Schwabe | 108/159 |
| 1,979,843 | 11/1934 | Roos | 108/159 |
| 2,057,334 | 10/1936 | Hannum | 108/157 |
| 2,411,620 | 11/1946 | English | 312/140.2 |
| 2,771,334 | 11/1956 | Wahlbom | 312/140.2 |
| 2,808,305 | 10/1957 | Jackson | 312/140.2 |
| 2,857,227 | 10/1958 | Jacques | 108/157 X |
| 3,033,632 | 5/1962 | Felten | 312/140.2 |
| 3,561,376 | 2/1971 | Knoblock | 108/157 |

*Primary Examiner*—Peter A. Aschenbrenner
*Attorney, Agent, or Firm*—Cort Flint

[57] ABSTRACT

A folding table device (10,10*a*) comprising a removable table top (11, 11*a*,11*b*) and a hinged frame assembly (12,12*b*). The frame assembly has recesses (26,27) or a detent-and-recess (30,34) arrangement for neatly securing the table top for storage in a vertical position in which the table top is held when the frame assembly is folded. The removable top, held in place with horizontal stops (25*a*,25*b*) may be reversible, with a different pattern or material on each major side, or may have a routed perimeter (A) to nest in the top of the frame assembly for a securer fit.

13 Claims, 5 Drawing Sheets

Fig. 7
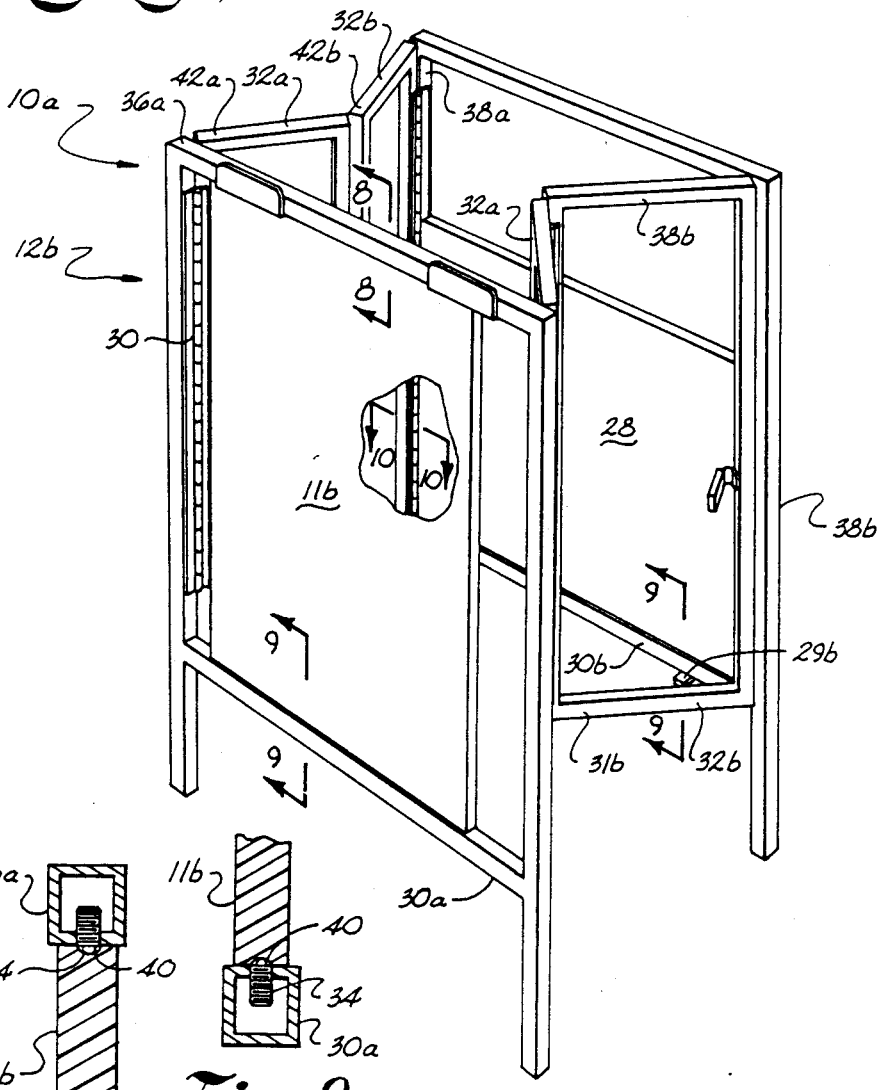
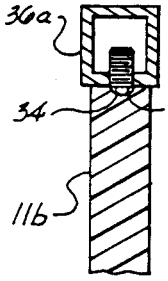
Fig. 9
Fig. 8
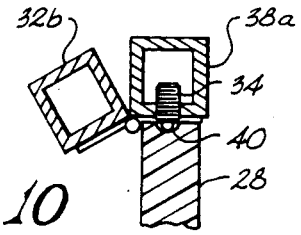
Fig. 10

PORTABLE SELF-STORING FOLDING TABLE

BACKGROUND OF THE INVENTION

This invention relates to folding tables, and, more particularly, to devices that may be folded for storage and unfolded to serve as tables for temporary use such as for picnics, camping, and the like.

Folding tables are well known in the prior art. In particular, the "card" table comprising a flat surface and four legs that each fold under the flat surface and along one side of the flat surface, has been in existence for many years. Although a card table serves well the purpose implied by its name, it is notoriously unstable for use in serving food or for supporting heavier objects.

Several tables have been the subject of patents in the past. Wilson's Folding Table (U.S. Pat. No. 1,072,550) comprises a multi-section hinged frame having four adjustable legs secured by wing nuts. Hendershott's Collapsible Stand or Table (U.S. Pat. No. 1,251,661) comprises s top supported by a set of hinged members that, when folded, form a stack and when unfolded for supporting the top, form a base in a cruciform shape.

Allen's U.S. Pat. No. 2,639,114 for a Collapsible, Adjustable Supporting Base for Pinball Machines comprises hinged end wall pairs that fold inwardly between two longer side walls. Supports are attached to the insides of the base for receiving a pinball machine. When folded the base has no means for storing the pinball machine.

A Collapsible Tea Cart is the subject of Worthington's U.S. Pat. No. 4,522,130. The tea cart frame also has hinged ends that fold inwardly between two longer sides. Two trays rest on frame's end rails and may be stored, after the frame is folded, between the sides and the end rails. To set up the Worthington tea cart, the trays must be removed and set aside, the frame unfolded, and the trays placed in position.

Some of the prior art tables do not store the supported top. Some do not provide sufficient supportive strength in a lightweight frame. None of the prior art patents has a means for storing a supported table top on the supporting frame as the frame is folded and unfolded. None has a means for securing the folded table to prevent unfolding.

Accordingly, an object of the present invention is to provide a lightweight, highly transportable table.

Another object of the present invention is to provide a table that is easily folded and unfolded.

Another object of the present invention is to provide a table that can be unfolded in a single motion.

Still a further object of the present invention is to provide a foldable table that does not unfold when in the folded position.

Still another object of the present invention is to provide a foldable table that does not fold when in the unfolded position.

Yet another object of the present invention is to provide a foldable table having a table top secured from horizontal and downward vertical movement.

Yet another object of the present invention is to provide a foldable table having a means for securing the table top to a folded table for transportability.

SUMMARY OF THE INVENTION

The above objectives are accomplished according to the present invention by providing a foldable frame assembly, and a removable table top. The frame assembly further comprises two side frames and two pairs of end frames, one pair of end frames on each end of the frame assembly. The side frames and pairs of end frames are interconnected by hinges, generally forming a rectangular box, so that the end frames can fold inwardly as the side frames move towards each other. When the folding table is in use, the table top is held in place by stops fastened to the frame assembly. When ready for storage, the table top may be neatly secured to sides of the frame assembly by sets of recesses in their perimeters and detents in the side frames, the detents mating with the recesses. Alternatively, the table top may be secured into an open-sided routed recess in the top and bottom rails, or by sliding it through a slot cut into a widened top rail of one of the side frames and into a recess cut into a widened bottom rail of the same side frame. The table top may be reversible, showing different patterns or material on the two major sides. Alternatively, one side of the perimeter of the table top may be routed to nest within the top of the frame assembly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 7 is a perspective view showing a partially folded frame assembly with the bottom shelf and table top secured in the sides of the frame assembly according to the invention;

FIG. 8 is a sectional detailed view along line 8—8 of FIG. 7 according to the invention;

FIG. 9 is a sectional detailed view along line 9—9 of FIG. 7 according to the invention; and FIG. 10 is a sectional detailed view along line 10—10 of FIG. 7 in accordance with the invention.

DESCRIPTION OF A PREFERRED EMBODIMENT

Figure 1:
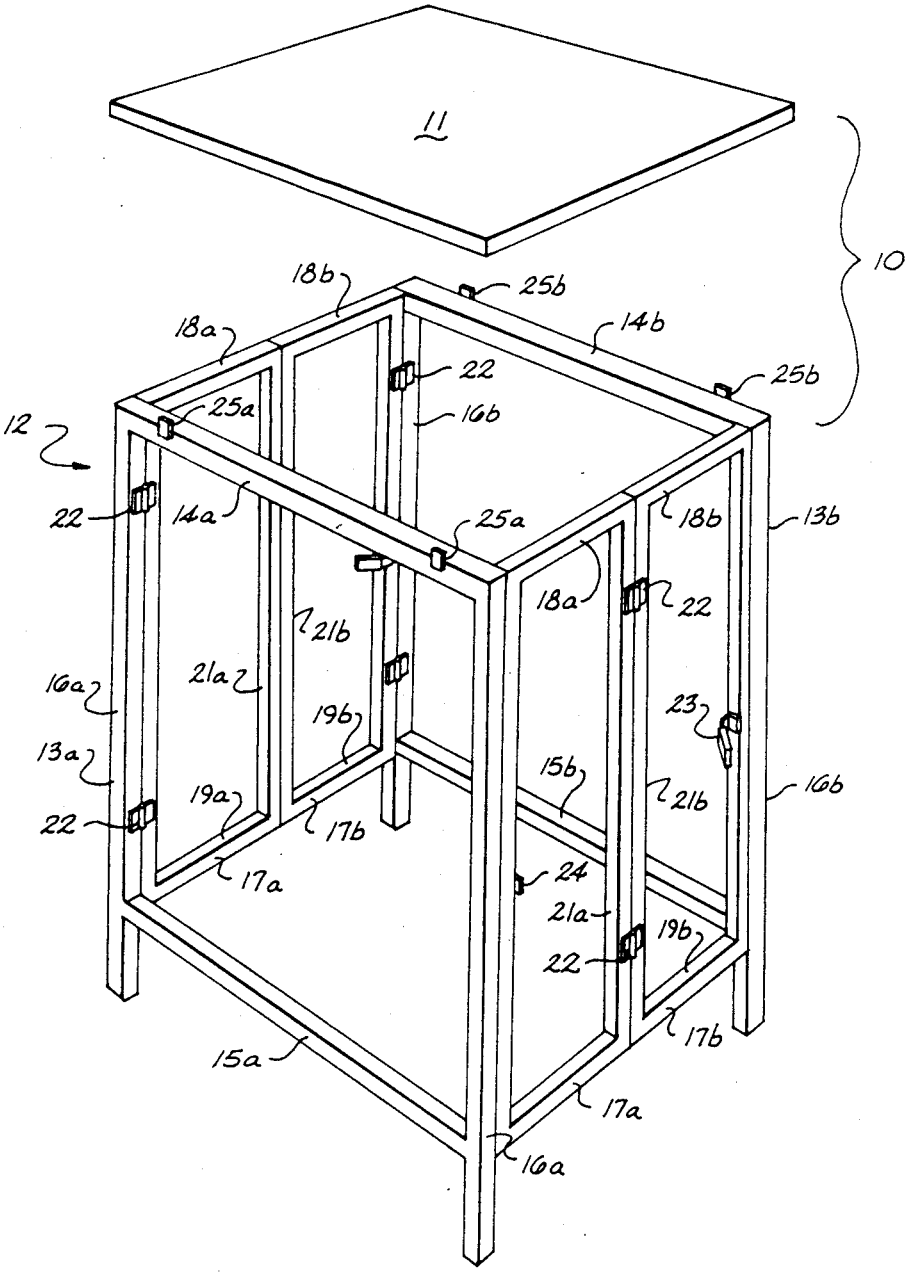
FIG. 1 is an exploded perspective view of the unfolded foldable table according to the invention.

Referring now in more detail to the drawings, the present invention comprises generally a foldable table 10 having a table top 11 and a frame assembly indicated generally at 12 in FIG. 1. Frame assembly 12 has two side assemblies **13*a* and 13*b*, each having a top rail 14*a*, 14*b*, and a bottom rail 15*a*, 15*b***, and two end rails each 16*a*, 16*b*. Frame assembly 12 has two pairs of end frames 17*a*, 17*b*, one pair on each end of frame assembly 12. Each end frame has a top rail 18*a*, 18*b*, and a bottom rail 19*a*, 19*b*, an outside rail 20*a*, 20*b*, and inside rail 21*a*, 21*b*.

Figure 2:
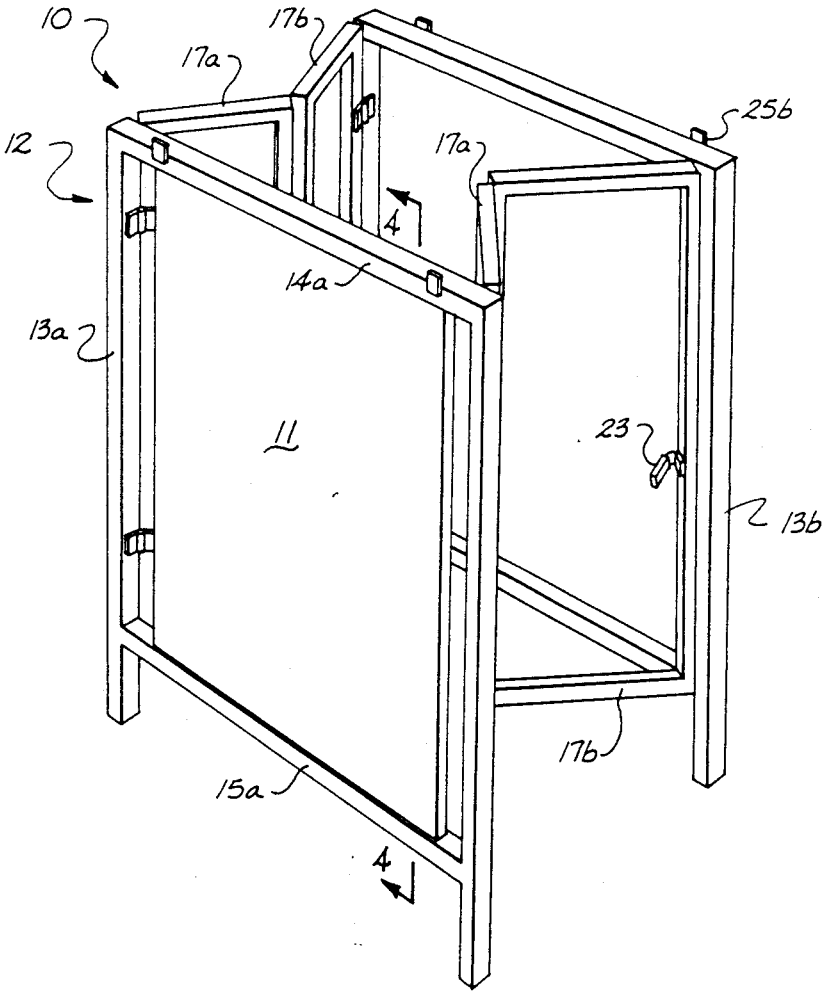
FIG. 2 is a perspective view of the foldable table illustrating a partially folded frame assembly according to the invention.

Hinges 22 connect inside rails 21*a* and 21*b*, outside rails 20*a* to end rails 16*a*, and outside rails 20*b* to end rails 16*b*. Hinges 22 allow pairs of end frames 17*a* and 17*b* to fold inwardly, as best illustrated in FIG. 2, so that side frames 13*a* and 13*b* move towards each other. When frame assembly 12 is in a folded condition, latches 23 secure to catches 24 to hold side frames 13*a*, 13*b* together and thereby frame assembly 12 is prevented from unfolding. Stops 25*a*, 25*b* on top rails 14*a*, 14*b*, respectively, limit the horizontal movement of table top 11. Top rails 14*a*, 14*b*, 18*a*, 18*b*, of side frames 13*a*, 13*b*, 17*a*, 17*b*, respectively, prevent downward vertical movement of table top 11.

Figure 3:
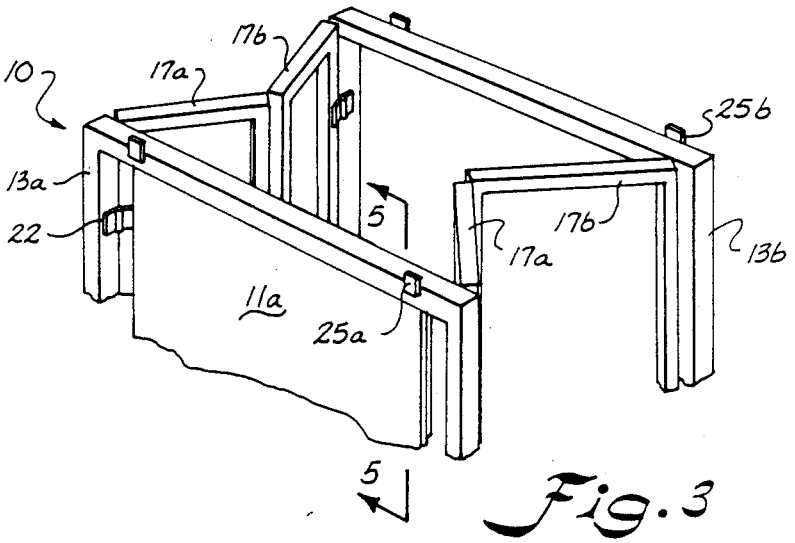
FIG. 3 is a perspective view showing a table top in the slot-and-recess means in accordance with the invention.
Figure 4:
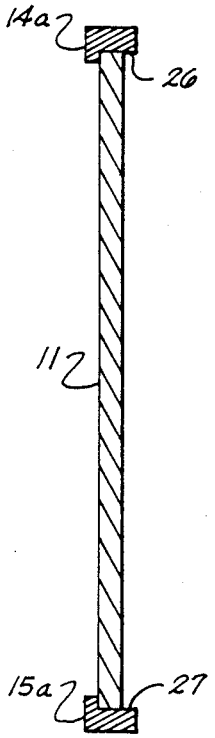
FIG. 4 is a sectional view along line 4—14 of FIG. 2 showing the secured table top according to the invention.
Figure 5:
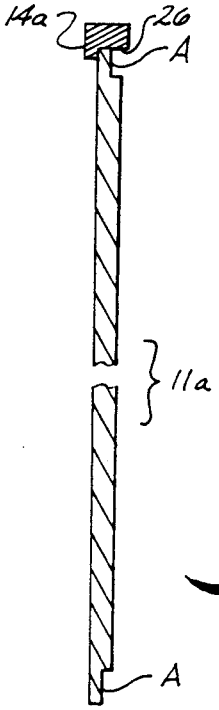
FIG. 5 is an alternate, sectional view along line 5—5 of FIG. 3 showing the secured table top according to the invention.
Figure 5A:
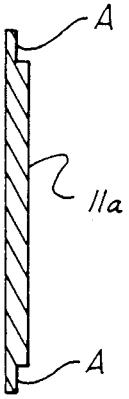

Table top 11 may be secured for storage in side frame 13*a* which has a recess means in the form of routed generally "L" shaped slots or recesses 26, 27, respectively, as can best be seen in FIGS. 4 and 5. Table top 11 slides into recesses 26 and 27 from the interior of table 10. As frame assembly 12 is folded, the top is captivated by opposed end frames 17*a* folded inwardly (FIG. 3) A detailed view of table top 11 secured within the recesses of frame assembly 12 as shown in FIG. 4. The perimeter of table top 11 may be reversible to accommodate different materials, structural features or designs, such as game board patterns, on each major side. Alternatively, one major side of a table 11*a* may have a routed perimeter A about its four edges so that it nests within top rails 14*a*, 14*b*, 18*a*, 18*b* for further stability without need of tabs 25*a*, 25*b*. As can best be seen in FIGS. 3 and 5, table top 11*a* with routed perimeter stores in the same fashion as a reversible table top.

Figure 6:
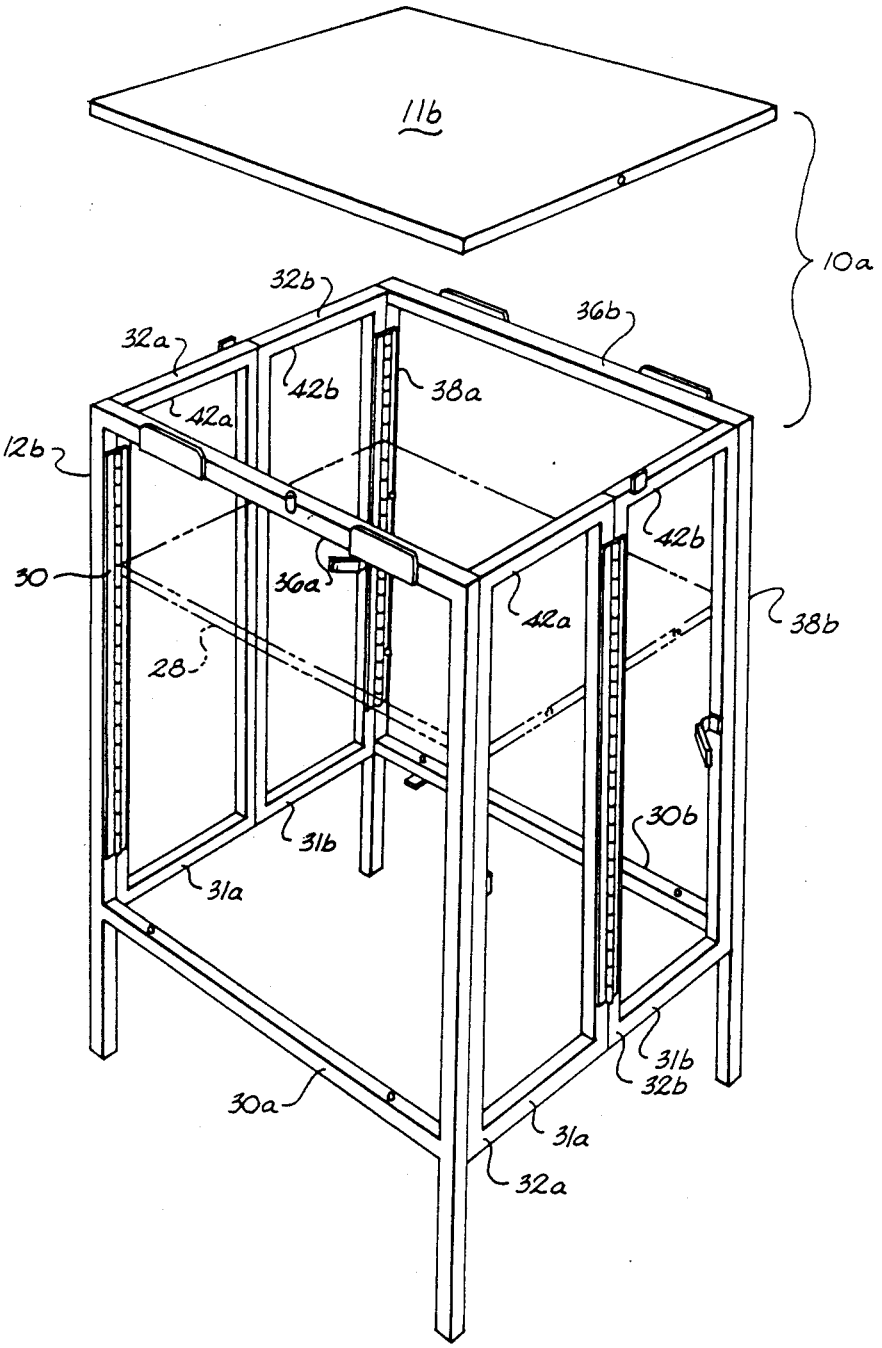
FIG. 6 is a perspective view illustrating an alternative embodiment of the foldable table according to the present invention.

Another embodiment of a folding table constructed in accordance with the invention is disclosed in FIGS. 6 and 7 wherein a table illustrated generally at 10*a*, has a bottom shelf 28 in addition to a table top 11*b*. Bottom shelf 28 slides within a frame perimeter defined by side rails 30*a*, 30*b*; and folding end rails 31*a*, 31*b* of end frames 32*a*, 32*b*, respectively; and rests on stops 29*a*, 29*b*. Stops 29*a*, 29*b* prevent downward vertical movement of bottom shelf 28. Bottom rails 30*a*, 30*b*, 31*a*, 31*b* surround the perimeter of bottom shelf 28 to prevent horizontal movement. Hinges 22 may be a standard leaf hinge type, as can best be seen in FIG. 1, or preferably piano hinges 30 as can best be seen in FIG. 6. Piano hinges provide better alignment and a larger gripping surface for joining the narrow rails.

As an alternative means of securing table top 11*b* and bottom shelf 28 to frame assembly 12*b*, preferred especially if frame assembly 12*b* is made of square cross-section metal tubing, are ball-bearing detents 34 fitted into bottom rails 30*a*, 30*b*, top rail 36*a*, and the end standards 38*a*, 38*b* to mate with rounded recesses 40 in the perimeters of table top 11*b* and bottom shelf 28. FIGS. 8, 9, and 10 show detailed views of detents 34 and recesses 32 at several locations of table top 11*b* and bottom shelf 28.

It will be noted that table top 11*b* has a length generally equal to the distance between top end rails 42*a*, 42*b*, inclusively, and that the distance between top rail 36*a* and bottom rail 30*a* is the same. Bottom shelf 28 has a length generally equal to the distance between bottom end rails 31*a*, 31*b*, exclusively, and that the distance inbetween standards 38*a*, 38*b* is generally the same. In this regards, it is noted that table tops 11 and 11*a* are dimensioned to be generally equal to the distance between opposing top and bottom rails 14*a*, 15*a*.

While a preferred embodiment of the invention has been described using specific terms, such description is for illustrative purposes only, and it is to be understood that changes and variations may be made without departing from the spirit or scope of the following claims.

What is claimed is:

1. A lightweight portable folding table comprising:
a table top having a perimeter;
a frame assembly for receiving said table top;
said frame assembly having hinge means for moving said frame assembly between a folded position of said frame assembly and an unfolded position;
said frame assembly having a first securing means for securing said table top to said frame assembly in a horizontal position when said frame assembly is in said unfolded position and for preventing said frame assembly from moving from said unfolded position to said folded position;
said frame assembly having a second securing means for securing said table top to said frame assembly in a vertical position when said frame assembly is in said folded position;
said second securing means comprises a recess means for securing said table top to said frame assembly as said frame assembly is moved between its folded position and its unfolded position, said table top not interfering with said frame assembly movement;
said frame assembly includes two side assemblies each having a top rail and a bottom rail, and said recess means includes an elongated recess formed in an underneath of said top rail having a cross-section for accommodating said table top in a nested configuration and an elongated recess in said bottom rail for engaging a lower end of said table top nested in said recess for mounting said table top within said side assembly.

2. The device of claim 1 wherein said first securing means further comprises a plurality of horizontal stops secured to said frame assembly for engaging the perimeter of said table top in said horizontal position so as to prevent horizontal movement of said top.

3. The device of claim 1 wherein said first securing means comprises said table top having an underside, said underside being routed along said perimeter so that said table top can be nested within a perimeter of said frame assembly.

4. The device of claim 1 wherein said recess for retaining said table top includes a generally "L" shaped open sided recess slot in which said table top is captivated by said frame assembly in said folded position.

5. The device of claim 4 wherein said top rail and bottom rail of said side assemblies are spaced apart a distance generally equal to the length of said table top.

6. The device of claim 1 further comprising:
a bottom shelf slidably fitting within said frame assembly and having an underside; and
a plurality of vertical stops for engaging said underside of said bottom shelf, said vertical stops attached to said frame assembly for preventing downward movement of said bottom shelf.

7. The device of claim 1 wherein said frame assembly has a latch means for preventing said frame assembly from moving from said folded position to said unfolded position.

8. The device of claim 1 wherein said hinge means comprises a plurality of piano hinges.

9. The device of claim 1 wherein said hinge means comprises a plurality of leaf hinges.

10. A light weight portable folding table comprising:

a table top having a perimeter;

a frame assembly for supporting said table top having a pair of side frames and a pair of end frames, said end frames being hinged in said frame assembly for moving said frame assembly between an unfolded position in which said table top is supported on said frame assembly and a folded position;

an underside of said table top being routed along the perimeter of said table top defining a downward face which can be nested within the perimeter of said frame assembly wherein said frame assembly is in said unfolded position, said routed face of the underside of said table top securing said table top in a horizontal position to said frame assembly and maintaining said frame assembly in said unfolded position;

said first side assembly including a top rail and a bottom rail;

said top rail of said first side assembly having upper recess means for receiving and retaining said table top; and said bottom rail including lower recess means for retaining a lower end of said table top in a generally vertical position when said upper end is retained by said upper recess means in a manner that said frame assembly may be folded with said table top in said vertical assembly for captivation and transportation.

11. The device of claim 10 wherein said recess means in said top and bottom rails of said first side assembly includes a recess slot having an open side which receives said upper and lower ends of said table top in said vertical position from an interior of said table.

12. A lightweight portable folding table comprising:

a table top having a perimeter;

a frame assembly for receiving said table top;

said frame assembly having hinge means for moving said frame assembly between a folded position of said frame assembly and an unfolded position;

said frame assembly having a first securing means for securing said table top to said frame assembly in a horizontal position when said frame assembly is in said unfolded position and for preventing said frame assembly from moving from said unfolded position to said folded position;

said frame assembly having a second securing means for securing said table top to said frame assembly in a vertical position when said frame assembly is in said folded position;

said second securing means comprises a detent/recess means for securing said table top to said frame assembly as said frame assembly is moved between its folded position and its unfolded position, said table top not interfering with said frame assembly movement;

said frame assembly includes a pair of side frame assemblies, and a pair of foldable end frame assemblies attached between said first and second side frame assemblies;

said first side frame assembly having a top rail and a bottom rail spaced apart a distance generally equal to the length of said table top;

said detent/recess means includes a detent and a projection carried by opposing surfaces of said top and bottom rails and ends of said table top for interlocking with each other; and said table top being recessed within said top and bottom rails and side rails of said side assemblies for storage and transportation without interfering with the folding of said table and locking of said table in said folding position.

13. The device of claim 12 wherein said table includes a bottom shelf dimensioned to fit having a length which is slightly less than the length of said end frames of said table and a width which is slightly less than the inside dimensions of said bottom rails so that said shelf sits within said end rails; and means for locking said bottom shelf in a vertical position between said side rails of said second assembly and said bottom rail of said second assembly.

* * * * *